US007886944B2

(12) United States Patent
Damrath et al.

(10) Patent No.: US 7,886,944 B2
(45) Date of Patent: Feb. 15, 2011

(54) INFLATING BODY FOR PRESSING A PIECE OF CLOTHING

(75) Inventors: Joachim Damrath, Bachhagel (DE); Klaus Grunert, Berlin (DE); Kathrin Redlin, Berlin (DE); Markus Spielmannleitner, Ellwangen (DE); Gerhard Wetzl, Sontheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 2 days.

(21) Appl. No.: 10/569,522

(22) PCT Filed: Aug. 26, 2004

(86) PCT No.: PCT/EP2004/009549

§ 371 (c)(1),
(2), (4) Date: Feb. 24, 2006

(87) PCT Pub. No.: WO2005/021858

PCT Pub. Date: Mar. 10, 2005

(65) Prior Publication Data

US 2006/0261102 A1 Nov. 23, 2006

(30) Foreign Application Priority Data

Aug. 28, 2003 (DE) ..... 103 39 722

(51) Int. Cl.
*A41H 5/00* (2006.01)

(52) U.S. Cl. ..... 223/70; 223/68; 223/67; 223/66

(58) Field of Classification Search ..... 223/67–68, 223/70, 72–74; 38/84–85, 14; 100/73
See application file for complete search history.

(56) References Cited

U.S. PATENT DOCUMENTS

| | | | | |
|---|---|---|---|---|
| 3,262,615 | A | 7/1966 | Killey | |
| 3,385,485 | A | 5/1968 | Aloi | |
| 3,568,900 | A * | 3/1971 | Paris | 223/70 |
| 4,475,673 | A * | 10/1984 | Ochiai | 223/70 |
| 5,148,955 | A * | 9/1992 | Cares | 223/70 |
| 5,555,648 | A * | 9/1996 | Griffin | 34/621 |
| 2004/0003519 | A1 | 1/2004 | Damrath et al. | |
| 2006/0261101 | A1 * | 11/2006 | Damrath et al. | 223/66 |

FOREIGN PATENT DOCUMENTS

| | | |
|---|---|---|
| DE | 32 23 359 | 12/1983 |
| DE | 3514552 | 10/1986 |
| EP | 0 095 781 | 12/1983 |
| JP | 2000202194 | 7/2000 |
| WO | WO 99/49123 | 9/1999 |

OTHER PUBLICATIONS

International Search Report for PCT/EP2004/009549.

* cited by examiner

*Primary Examiner*—Shaun R Hurley
*Assistant Examiner*—Andrew W Sutton
(74) *Attorney, Agent, or Firm*—James E. Howard; Andre Pallapies

(57) ABSTRACT

The invention relates to an inflating body, for the drying and/or pressing of pieces of clothing, whereby said inflating body is made from sections with at least three different air permeabilities.

20 Claims, 2 Drawing Sheets

INFLATING BODY FOR PRESSING A PIECE OF CLOTHING

Figure 1:
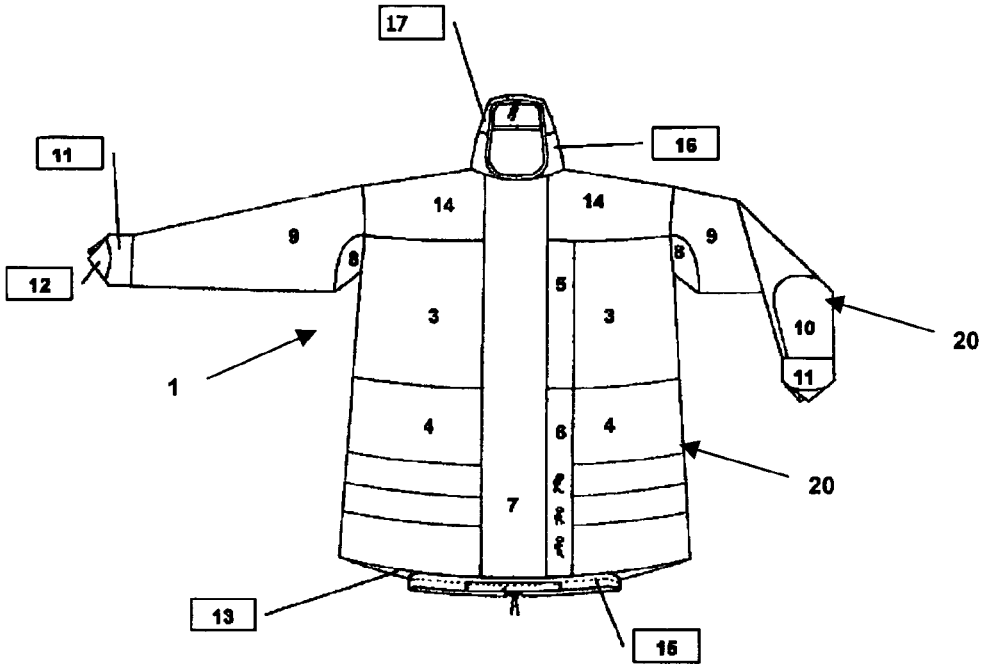

The present invention relates to an inflating body for pressing a piece of clothing, especially a piece of clothing for the upper body, such as for example a shirt, a blouse or a jacket.

It is known to dry or press items of clothing by pulling these onto an inflating body which is also designated as an inflatable dummy and which substantially has the shape of the garment to be ironed, and this inflating body is provided with air or steam from inside. The inflating body is inflated by the supply of air or steam and tensions the items to be ironed or dried from inside. In this case, the piece of clothing is dried or pressed on the one hand by means of the pressure applied to the piece of clothing by the inflated inflating body. In addition, the casing of the inflating body can have a certain air permeability to allow flow through the material of the piece of clothing. The pressure applied to the piece of clothing and the quantity of air flowing through the material of the piece of clothing thus determine the degree of drying and the pressing result which can be achieved with the device. In order to be able to achieve adequate drying of areas of the piece of clothing in which more than one layer of material is superimposed, it has been proposed in the prior art to provide openings in the casing of the inflating body at these regions. Such a solution is described for example in WO 99/49123. Also known from EP 0096080 is a body-shaped bag for drying and shaping items of clothing wherein areas having an elevated air permeability are provided in the areas in which a plurality of material layers are superposed.

The provision of one air permeability in one region and an elevated air permeability in a further region can thus ensure reliable drying of multilayer parts of the item of clothing. However, it should be noted that as a result of the flow relationships prevailing therein, in some areas of the inflating body even areas having more than one material layer are dried more rapidly than other areas. Thus, if one area in which a plurality of material layers are present on the item of clothing is continuously brought in contact, as in the prior art, with an area of the inflating body having a high air permeability, escape of unused air via these areas can occur at locations of the inflating body. However, attention should be paid to minimising the energy consumption especially in domestic appliances. In addition, the provision of areas having high air permeability on the inflating body at all locations intended to dry a plurality of material layers, can have the consequence that as a result of the air escaping via these regions, a pressure build-up cannot be achieved in the inflating body or can only be achieved if extremely high quantities of air are introduced into the inflating body. If large quantities of air are introduced at too-high pressure, this can again yield a poor pressing result.

It is thus the object of the invention to provide an inflating body for drying and/or pressing items of clothing which also allows reliable drying and pressing of items of clothing in areas with a plurality of material layers and which can at the same time ensure a minimal energy consumption. Furthermore, it should be possible to achieve a simple build-up of pressure in the inflating body and the inflating body should be simple to manufacture.

The invention is based on the finding that this can be achieved by means of an inflating body wherein different sections with different air permeabilities are used.

The object is solved according to the invention by an inflating body for drying and/or pressing items of clothing wherein the inflating body is made from sections having at least three different air permeabilities.

By using sections having different air permeabilities, it is possible to take into account the requirement that both sufficient drying and a minimal loss of air should be ensured. Areas in which a plurality of material layers are indeed superposed but where a high pressure prevails as a result of the flow relationships inside the inflating body are configured as having a lower air permeability than areas above which a plurality of layers are to be dried but which are not directly exposed to flow from inside.

Furthermore, the manufacture of the inflating body can be simplified by using different sections each having the desired air permeability. In this case, the incorporation of openings in the sections can be omitted. Moreover, since the air permeability is dependent on the sections, small limited areas requiring a high air permeability can also be provided for example. These limited areas of specific air permeability cannot be provided on a large section or can only be provided at great expense, by adjusting air permeabilities, for example, by means of coatings.

The inflating body preferably has at least one section which has a medium air permeability with an air permeability value of 3 to 20 $L/m^2s$, preferably of 5 to 10 $L/m^2s$. These values are measured at a pressure differential of 100 Pa. Sections with this medium air permeability can be used, for example, in areas where a high degree of drying is required but which would result in too high loss of air as a result of the flow relationships if a section with a high air permeability was provided.

The sections configured as sealed can have an air permeability value of 0 to 3 $L/m^2s$, preferably of 0 to 1 $L/m^2s$ and the open sections can have an air permeability value of 100 to 250 $L/m^2s$, preferably of 150 to 210 $L/m^2s$. These values are also measured at a pressure differential of 100 Pa.

According to one embodiment, a section with medium air permeability is provided in the chest area of the inflating body. Breast pockets of an item of clothing where a plurality of material layers are present can be dried by this section for example.

In addition, an open section can be provided in the chest area. The open section is preferably arranged so that this is located at a position corresponding to the position of a logo applied or incorporated on a breast pocket of the item of clothing. By this means this area which consists both of a plurality of material layers and additionally of the material of the logo can be reliably dried. The open section is therefore hereinafter also designated as logo drying. The section of medium air permeability likewise disposed in the chest area on the other hand can be used for drying the breast pocket itself. Since this section need not be configured as open, this can extend over the entire chest area of the inflating body without the need to fear too-great loss of air. In addition to the drying of the logo, the drying of the remaining pocket area can be assisted by the open section by means of the capillary fibres of the material of the item of clothing.

The shape of the open section in the chest area is preferably strip-shaped. This can extend over the length of the entire chest area of the inflating body. By this means the cut of the entire front side of the inflating member can be kept simple. In addition to the strip for the logo drying, a single further section of medium air permeability can be provided for the chest area which substantially has a rectangular shape. A recess in the chest area for sewing in the logo drying and expensive sewing can thus be dispensed with.

According to a further embodiment, a section of medium air permeability can be provided in the shoulder area of the inflating body. This section can be used to dry the yoke of the item of clothing. In this case, this section extends over the entire width of the back of the inflating body as far as the upper area of the front of the inflating body. The material layers of the yoke, which is usually configured as multilayered need to be dried in this area. However, as a result of the size of this area, high losses of air can occur after drying the yoke if the area is provided with a high air permeability. In addition, the use of a section of medium air permeability in this area has the advantage that in shirts or blouses having no multilayered yoke the loss of air can be minimised compared with the use of a highly air-permeable section. The inflating body can therefore be used flexibly.

In a further embodiment, a section of medium air permeability is incorporated in the inflating body in the area of the cuff slit. The use of such a section in this area can firstly ensure drying of the slit configured as multilayered and secondly minimise the air loss in this area. Especially in inflating bodies where the sleeve sections of the inflating body are directly supplied with air, the provision of a highly permeable section would result in too-rapid drying of the cuff slit and therefore in a high loss of air.

Figure 2:
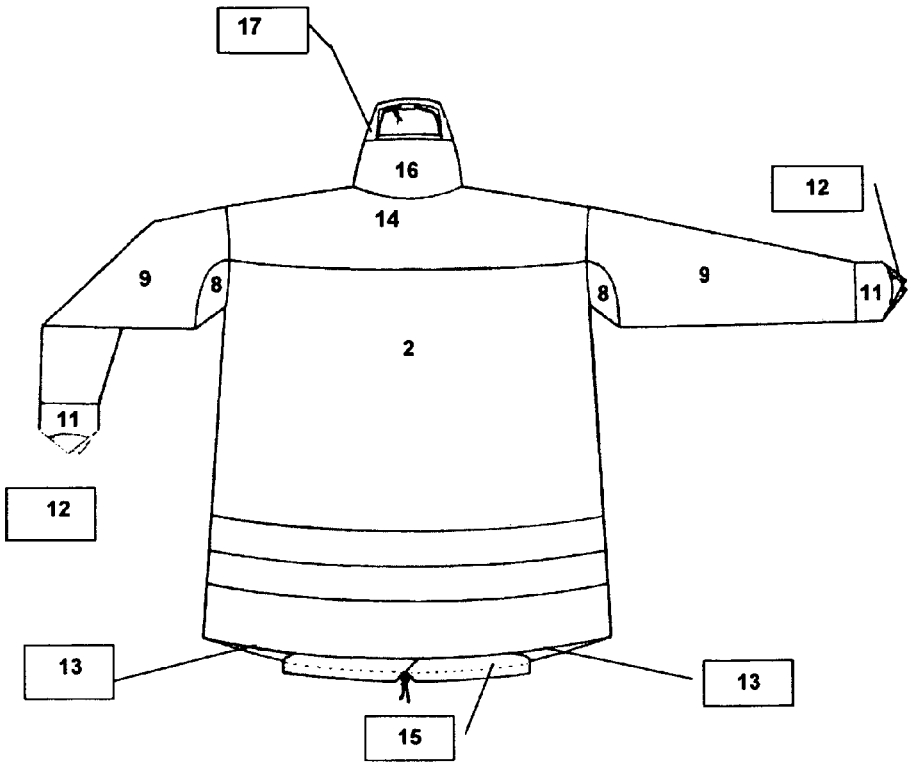

The invention is described hereinafter with reference to the appended drawings using one possible exemplary embodiment. In the figures:

FIG. 1 is a schematic front view of one embodiment of the inflating body according to the invention; and FIG. 2 is a schematic rear view of one embodiment of the inflating body according to the invention.

FIG. 1 shows one embodiment of an inflating body 1 according to the invention. This has a torso section 20 and two sleeve sections 30.

The sleeve sections 30 each consists of the following sections which are substantially named according to the parts of the piece of clothing which is to be dried and pressed using this inflating body. Provided at the end of the sleeve section 30 is a sleeve termination 12 followed by a cuff 11. The sleeve 9 is provided between the cuff 11 and the sleeve opening by means of which the sleeve section 30 is joined to the torso section 20. This sleeve is interrupted on one side of the sleeve section 30 by the cuff slit 10 adjacent to the cuff 11. Provided at the sleeve opening in the lower area of the sleeve section 30 is a gusset 8 which serves to enlarge the circumference of the sleeve section 20 in the immediate vicinity of the sleeve opening.

A strip 7 which serves to dry the button and the buttonhole strip of the item of clothing extends over the front of the torso section 20 substantially over the entire length of the torso section 20. Located in the shoulder areas of the torso section 20 is the front portion of a yoke 14 which continues over the shoulder section at the back of the torso section. In the embodiment shown a chest area 3 is provided below the yoke 14 on the left side of the strip 7. This is followed in the downward direction by a lower front portion 4. Torso pulls indicated by the externally visible seams in the embodiment-shown are incorporated in the lower front portion 4. Cords or other tensioning means are guided in these internal torso pulls, allowing a certain torso circumference to be adjusted in the lower area of the torso section. This is important to avoid an item of clothing pulled onto the inflating body 1 from slipping upwards.

The right front side in the embodiment shown differs from the left side located on the other side of the strip 7. The shoulder section is also formed by the front area of the yoke 14 on the right side. This is followed by a chest area 3. However, this has a narrower width than the width of the yoke 14. Provided between the chest area 3 and the strip is a logo drying area 5 which compensates for the difference in the width between the yoke 14 and the chest area 3 on the right front side. The logo drying area 5 is in the shape of a strip. A lower front portion 4 with torso pulls is in turn located below the chest area 3. The lower front portion 4 has a width which is also smaller than the width of the front area of the yoke 14. The width of the lower front portion 4 on the right side corresponds to the width of the chest area 3 on the right side. Provided next to the front portion 4 and below the logo drying area 5 is an eye strip 6 via which the ends of the cords or other tensioning means of the interior torso pulls can be guided out from the inflating body 1.

Provided at the collar area of the inflating body 1 is a collar 16 whose collar opening is partly covered by a collar over-tensioner 17. Provided on each side at the lower edge of the torso section 20 are bottom portions 13 which reduce the circumference of the torso section 20 from the circumference in the area of the lower front portions 4 and the lower area of the back 2 to a circumference corresponding to a bottom edge 15 which is provided at the lower edge of the torso section 20 and by means of which the inflating body 1 is connected to a lower portion in which a housing (not shown) can be provided for a blower.

FIG. 2 shows a rear view of the inflating body 1. The back of the torso section is formed by the yoke 14 which extends over the entire width of the back of the torso section 30 and a back 2 adjacent thereto at the bottom where torso pulls are again provided in its lower area. The back extends from the yoke 14 as far as the lower edge of the torso section 30.

In the embodiment shown, most of the sections consist of an air-impermeable material, preferably a textile material. This preferably has an air permeability of 0-1 $L/m^2s$ measured at a pressure differential of 100 Pa.

The yoke on the other hand consists of a material of medium air permeability of preferably 5 to 10 $L/m^2s$, measured at a pressure differential of 100 Pa. The yoke of the item of clothing is adjacent to the yoke 14 during the drying and pressing process. This yoke is generally constructed as multilayered which is why an increased air supply to this part of the item of clothing is required. However, the length of the yoke in some items of clothing is shorter than in others and some items of clothing have no yoke at all. These different items of clothing can be dried or pressed using the inflating body according to the invention since the loss of air can be kept low by the choice of a section having a medium air permeability.

Furthermore, the section of the cuff slit 10 is a section having a medium air permeability. The slit which is adjacent to the cuff in buttoned cuffs rests in this area during the pressing process. Since the cuff which is likewise constructed as multilayered rests on the end of the sleeve of the item of clothing, it is preferable to supply the area of the lower sleeve directly with air. This can be accomplished via pipes or via an inner inflating body which extends at least partly into the sleeve section of the inflating body and an opening for the air outlet in the lower sleeve section is provided at its end. As a result of this high air supply in the lower sleeve region, a high loss of air can occur when the cuff slit is dried if the section of the cuff slit 10 has a high air permeability. According to the invention, this air loss can be reduced or prevented by using a section having a medium air permeability. Nevertheless, this section can ensure sufficient drying of the cuff slit of the item of clothing.

In the embodiment shown, the sections of the strip 7, the cuff 11 and the collar 6 are made of a material having a high air permeability. During the drying and pressing process a plurality of material layers rest on these sections of the inflating body and in addition fastening or fixing devices are generally provided in these regions by which means the item of clothing is held on the inflating body and by which means the parts are held in shape. A high air supply is thus required for the drying in these regions and the air loss is minimised by the presence of fixing devices.

In the embodiment shown the chest area 3 is a section with a medium air permeability. In this area breast pockets are provided on items of clothing, especially on shirts, which require a higher air supply because of the plurality of layers from which they are formed. However, items of clothing on which a pocket is only provided on one side, for example, should also be able to be dried and pressed using the inflating body. The air loss in shirts of this type would be too great if the chest areas were to have a high air permeability on both sides of the front of the torso section. In addition, the chest area can lie in the vicinity of the point of introduction of air into the inflating body whereby the air loss is further increased. With the section having a medium air permeability according to the invention, however, the air loss is minimised and at the same time, a good drying result is achieved at the pocket.

Provided on the right side of the front of the torso section 20 in the embodiment shown is a logo drying area 5 which consists of a section of high air permeability. This section makes it possible to dry logos or other applications provided on shirts. In addition, the logo drying area 5 can be used to assist the drying of a breast pocket. Since this area is rapidly dried by the high air supply through the section of the logo drying area 5, the remaining area of the pocket is at least partly dried by means of the logo drying via the capillary forces of the fibres of the item of clothing. This assistance of the breast pocket drying can especially be used in shirts having no applications or logos on the breast pocket. However, this effect also comes about in breast pockets with logos. The inflating body according to the invention can thus be used for many different types of shirts.

The present invention is not restricted to the embodiment shown.

Although in the embodiment shown the logo drying is only provided on the right side, it is also within the scope of the invention to provide this on both sides.

The invention thus provides an inflating body which is firstly simple to manufacture and secondly allows drying and pressing of different items of clothing whereby a minimal loss of air and exceptional drying and pressing results can be achieved.

The invention claimed is:

1. An inflating body for drying and/or pressing items of clothing, the inflating body comprising multiple sections with at least three different air permeability values, the multiple sections including a cuff section having a high air permeability, a medium air permeability section having a medium air permeability value, and a reduced air permeability section having a reduced air permeability value that is less that the medium air permeability value of the medium air permeability section, and each of the medium air permeability section and the reduced permeability section being configured as inflating sections that have an inflated shape when an inflating medium is introduced into the respective section.

2. The inflating body according to claim 1, wherein the inflatable body has a medium air permeability section with an air permeability value of 3 to 20 L/m$^2$s.

3. The inflating body according to claim 2, wherein the medium air permeability section has an air permeability value of 5 to 10 L/m$^2$s.

4. The inflating body according to claim 1, wherein the reduced air permeability section has an air permeability value of 0 to 3 L/m$^2$s, and the inflating body has an open section with an air permeability value of 100 to 250 L/m$^2$s.

5. The inflating body according to claim 4, wherein the reduced air permeability section has an air permeability value of 0 to 1 L/m$^2$s and the open section has an air permeability value of 150 to 210 L/m$^2$s.

6. The inflating body according to claim 2, wherein the medium air permeability section is provided in a chest area of said inflating body.

7. The inflating body according to claim 2, wherein the medium air permeability section is provided in a shoulder area of said inflating body.

8. The inflating body according to claim 2, wherein the medium air permeability section is incorporated in said inflating body in an area of the cuff slit of an item of clothing.

9. An inflating body for drying and pressing items of clothing, comprising:

a medium air permeability section with an air permeability value of 3 to 20 L/m$^2$s;

a reduced air permeability section having a periphery and a body portion bounded by the periphery, both the periphery and the body portion of the reduced air permeability section operating to limit the permeation of air in a direction from an interior of the reduced air permeability section to the exterior and the reduced air permeability section having an air permeability value of 0 to 3L/m$^2$s; and an open section with an air permeability value of 100 to 250 L/m$^2$s.

10. The inflating body according to claim 9, wherein the medium air permeability section has an air permeability value of 5 to 10 L/m$^2$s, the sealed section has an air permeability value of 0 to 1 L/m$^2$s, and the open section has an air permeability value of 150 to 210 L/m$^2$s.

11. The inflating body according to claim 9, wherein the medium air permeability section is provided in a chest area of said inflating body.

12. The inflating body according to claim 9, wherein the medium air permeability section is provided in a shoulder area of said inflating body.

13. The inflating body according to claim 9, wherein the medium air permeability section is incorporated in said inflating body in an area of the cuff slit of an item of clothing.

14. The inflating body according to claim 9, wherein the body portion of the sealed section is formed of an air-impermeable material.

15. An inflating body for drying and/or pressing items of clothing, the inflating body comprising multiple sections with at least three different air permeability values, the multiple sections including a cuff section having a high air permeability and a medium air permeability section with an air permeability value of 3 to 20 L/m$^2$s, the medium air permeability section being incorporated in the inflating body in an area of a cuff slit of an item of clothing.

16. The inflating body according to claim 15, wherein the medium air permeability section has an air permeability value of 5 to 10 L/m$^2$s.

17. The inflating body according to claim 16, further comprising a reduced air permeability section that has an air permeability value of 0 to 3 L/m$^2$s.

18. The inflating body according to claim 17, wherein the reduced air permeability section has an air permeability value of 0 to 1 L/m$^2$s.

19. The inflating body according to claim 15, further comprising a reduced air permeability section that has an air permeability value of 0 to 3 L/m$^2$s.

20. The inflating body according to claim 19, wherein the reduced air permeability section has an air permeability value of 0 to 1 L/m$^2$s.

* * * * *